US007073468B2

(12) United States Patent
Akiba et al.

(10) Patent No.: US 7,073,468 B2
(45) Date of Patent: Jul. 11, 2006

(54) COMBUSTION TYPE POWER TOOL HAVING MOTOR SUSPENSION ARRANGEMENT

(75) Inventors: Yoshitaka Akiba, Hitachinaka (JP); Haruhisa Fujisawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/097,265

(22) Filed: Apr. 4, 2005

(65) Prior Publication Data

US 2005/0218179 A1 Oct. 6, 2005

(30) Foreign Application Priority Data

Apr. 5, 2004 (JP) ..... P2004-111526

(51) Int. Cl.
*F02B 71/00* (2006.01)

(52) U.S. Cl. ..... 123/46 SC; 227/10

(58) Field of Classification Search ... 123/46 R–46 H; 227/8, 10, 130
See application file for complete search history.

(56) References Cited

U.S. PATENT DOCUMENTS

| | | | | |
|---|---|---|---|---|
| 6,520,397 | B1 | 2/2003 | Moeller | |
| 6,619,527 | B1 | 9/2003 | Moeller | |
| 2004/0050901 | A1 * | 3/2004 | Turk | 227/130 |
| 2004/0173657 | A1 | 9/2004 | Turk | |

* cited by examiner

*Primary Examiner*—Noah P. Kamen
(74) *Attorney, Agent, or Firm*—Antonelli, Terry, Stout and Kraus, LLP.

(57) ABSTRACT

A combustion type power tool having a motor suspension arrangement capable of buffering a shock applied to a motor. An integral buffer member made from an elastic material is fixed to a head cap. The buffer member includes a motor storage section in which a motor casing is stored, and a plurality of buffer segments extending radially outwardly from the motor storage section and integrally therewith. Each radially outer end portion of each buffer segment is fixed to the head cap for floatingly supporting the motor storage section.

24 Claims, 5 Drawing Sheets

26

26

COMBUSTION TYPE POWER TOOL HAVING MOTOR SUSPENSION ARRANGEMENT

BACKGROUND OF THE INVENTION

The present invention relates to a combustion-type power tool, and more particularly, to such power tool having an improved motor mount structure.

In a conventional combustion-type driving tool such as a nail gun, a gaseous fuel injected into a combustion chamber is ignited to cause gas expansion in the combustion chamber, which in turn causes a linear momentum of a piston. By the movement of the piston, a nail is driven into a workpiece. In order to improve combustion, a fan is disposed in the combustion chamber for agitating a combustible gas. Such conventional combustion-type driving tool is disclosed in U.S. Pat. Nos. 4,483,280, Re 32,452 and 5,197,646.

A rotation drive unit such as a motor is disposed in a frame of the driving tool for rotating the fan. By the rotation of the fan, a turbulent flow is generated in the combustion chamber to promote combustion within the combustion chamber. Thus volumetric expansion occurs in the combustion chamber which in turn occurs impact. The impact is propagated to an entirety of the tool. Thus, the motor is also subjected to impact force.

In case of the combustion type fastener driving tool, the volumetric expansion generates movement of the piston for driving the fastener at the time of combustion. Surplus energy of the piston is absorbed at a bumper disposed within and one end of a cylinder in which the piston is slidingly moved. Acceleration is imparted to the entirety of the driving tool when the piston impacts against the bumper, and this acceleration is also transmitted to the motor.

Generally, the motor is not a shock proof precision instrument. Therefore, performance of the motor may be lowered due to structural damage caused by the repeated application of impact or shock, and finally the motor may be destroyed. To avoid this drawback, U.S. Pat. No. 6,520,397 discloses a cushioning member interposed between an outer frame and the motor so as to protect the motor against the shock. Thus, moderated shot transmission to the motor results.

More specifically, as shown in FIGS. 6 and 7, a combustion type fastener driving tool 101 includes a housing 102 having an upper end provided with a head cap 111 covered by a head cover 103. A motor 118 is supported to the housing 102 through the head cap 111. The motor 118 includes a motor case 118*a* serving as an outer casing, and a motor shaft 118*b*, and a fan 119 is fixed to a tip end of the motor shaft 118*b*. Further, an ignition plug 112 protruding into a combustion chamber 126 is supported to the head cap 111 at a position adjacent to the motor 118.

A pair of annular grooves are formed at an outer peripheral surface of the motor case 118*a*. The annular grooves are spaced away from each other in an axial direction of the motor case 118*a*. As shown in FIG. 6, retaining rings 114 are fitted into the pair of annular grooves, and an inner ring 113*a* which is a constituent of a suspension member 113 is interposed between the retaining rings 114,114.

As shown in FIG. 7, the suspension member 113 includes the inner ring 113*a*, an outer fixing metal 113*c* and a rubber member 113*b* fixed between the inner ring 113*a* and the fixing metal 113*c* by baking. The fixing metal 113*c* is fixed to the head cap 111. Thus, the motor 118 is connected to the head cap 111 through the suspension member 113.

If the driving tool 101 is subjected to impact force, the impact is transmitted to the fixing metal 113*c*, but is moderately transmitted to the inner ring 113*a* and to the motor 118 because of the damper effect of the rubber member 113*b*.

SUMMARY OF THE INVENTION

However, the present inventors recognized the following disadvantages in the conventional suspension arrangement. That is, in order to fix the motor 118 to the suspension member 113, the annular grooves must be formed at the motor case 118*a*. In other words, an ordinary available motor cannot be employed, but a motor having a special specification must be required as the motor 118, which increases a production cost. Further, since the suspension member 113 is made from two different materials, i.e., two metal rings 113*a*, 113*c* and the rubber member 113*b* and these members must be integrally connected by baking, reliability as to the connection may be lowered. These members may be separated from each other if the baking is insufficient. Furthermore, the baking process increases production cost.

Further, the rubber member 113*b* cannot be continuously distributed between the two rings 113*a* and 113*c*, since the ignition plug 112 is positioned adjacent to the motor 118. In other words, the rubber member 113*b* is cut off by the ignition plug 112. As a result, buffer function cannot be evenly provided over an entire region of the suspension member 113 against the shock imparted to the motor. Consequently, tensile stress is locally concentrated at the rubber member 113*b* nearby the ignition plug 112, to damage to the rubber member 113*b*.

It is therefore an object of the present invention to provide a combustion type power tool having a motor support structure having sufficient durability and capable of being produced easily at low cost.

This and other object of the present invention will be attained by a combustion-type power tool including a housing, a head portion, a cylinder, a nose, a push lever, a piston, a combustion-chamber frame, a motor, and a buffer member. The head portion is disposed at one end of the housing and is formed with a fuel passage. The cylinder is disposed in and fixed to the housing. The nose is positioned at the other end of the housing and extending from the cylinder. The push lever is movable along the nose in the longitudinal direction of the housing when the push lever is in pressure contact with a workpiece. The piston is reciprocally movable in the longitudinal direction and is slidable relative to the cylinder. The piston divides the cylinder into an upper space above the piston and a lower space below the piston. The combustion-chamber frame is disposed in the housing and is movable in the longitudinal direction in interlocking relation to the push lever. The combustion chamber frame is abuttable on the head portion to provide a combustion chamber in cooperation with the head portion and the piston. The motor includes a motor case disposed at the head portion at a position opposite to the combustion chamber, and an output shaft extending from the motor case and protruding into the combustion chamber. The buffer member is made solely from an elastic material and includes a motor storage section that supports the motor case, and a fixing section integrally extending form the motor storage section and fixed to the head portion.

In another aspect of the invention, there is provided a support structure for a motor that rotates a fan rotatable in a combustion chamber in a combustion-type power tool for driving a fastener into a workpiece. The power tool includes a tool body and generates an acceleration of the motor in an axial direction of the fan upon combustion in the combustion chamber. The acceleration causes the motor to move in the axial direction relative to the tool body. The support structure includes the buffer member made solely from an elastic material. The buffer member includes a motor storage section that stores the motor, and a fixing section integrally extending from the motor storage section and fixed to the tool body.

DETAILED DESCRIPTION OF THE PREFERRED EMBODIMENTS

Figure 1:
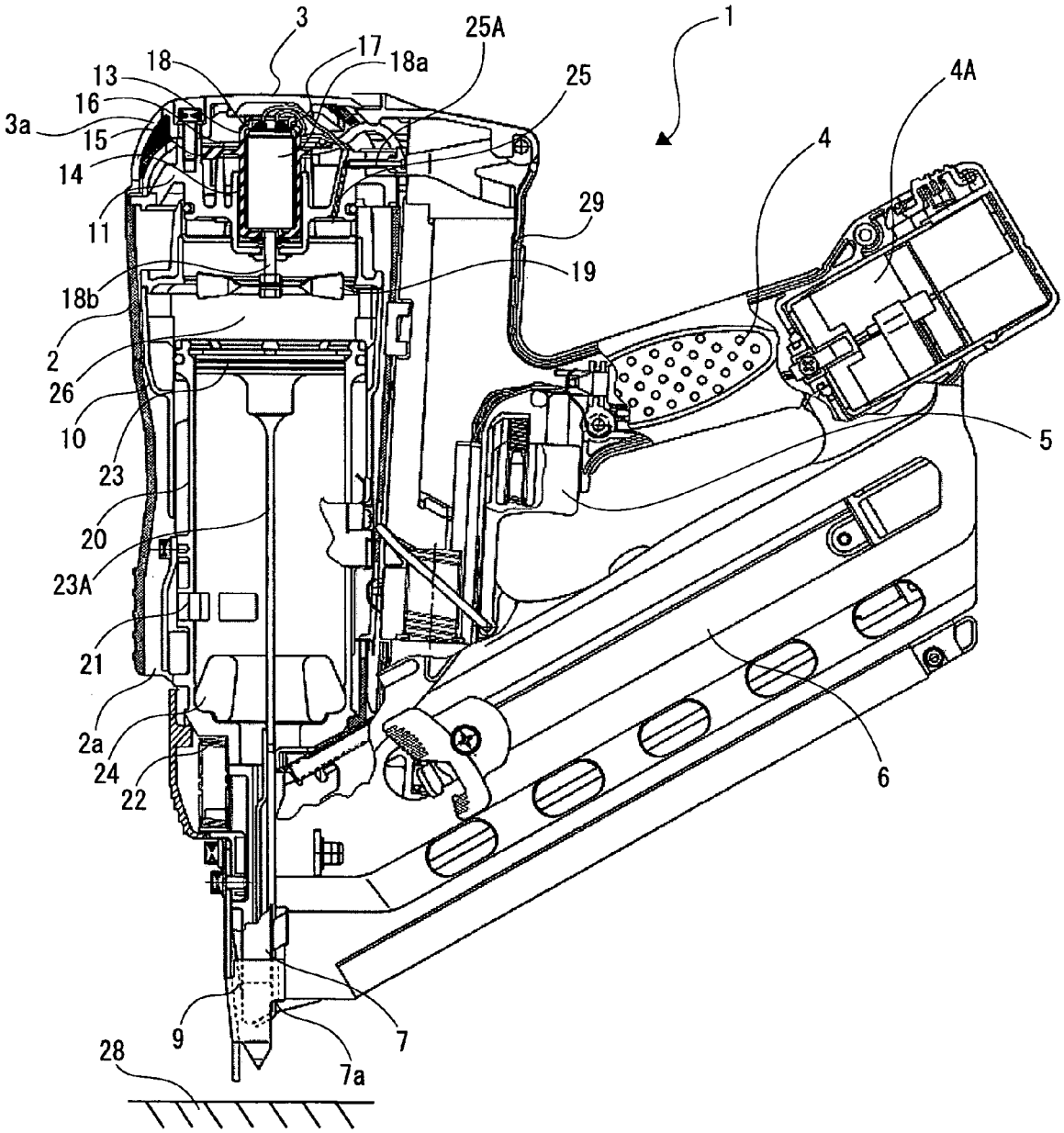
FIG. 1 is a vertical cross-sectional view showing a combustion type nail gun embodying a combustion type power tool according to an embodiment of the present invention.

A combustion-type power tool according to an embodiment of the present invention will be described with reference to FIGS. 1 through 5. The embodiment pertains to a combustion type nail gun. The combustion type nail gun 1 has a housing 2 constituting an outer frame. A head cover 3 formed with an intake port 3*a* is mounted on the top of the housing 2. A handle 4 is attached to the housing 2 and extends from a side of the housing 2. The handle 4 has a trigger switch 5 and accommodates therein a battery 4A. A canister housing 29 is provided in the handle 4 at a position immediately beside the housing 2. A gas canister (not shown) containing therein a combustible gas is detachably disposed in the canister housing 29. A magazine 6 is provided at a lower side of the handle 4. The magazine 6 contains nails (not shown). The housing 2 has a lower portion formed with an exhaust port 2*a* for discharging a combustion gas to the atmosphere.

A nose 7 extends from a lower end of the housing 2. The nose 7 is formed integrally with a cylinder 20 (described later) and has a tip end in confrontation with a workpiece 28. The nose 7 is adapted for guiding sliding movement of a drive blade 23A (described later) and for setting the nail to a predetermined position. A push lever 9 is movably provided and has a lower portion slidable with respect to the lower end portion of the nose 7. The push lever 9 is coupled to an arm member (not shown) that is engaged with a combustion-chamber frame 10 which will be described later through a pin (not shown). A compression coil spring 22 is interposed between the arm member and the cylinder 20 for normally urging the push lever 9 in a protruding direction from the housing 2. When the housing 2 is pressed toward a workpiece 28 while the push lever 9 is in abutment with the workpiece against a biasing force of the compression coil spring 22, an upper portion of the push lever 9 is retractable into the housing 2.

Figure 3:
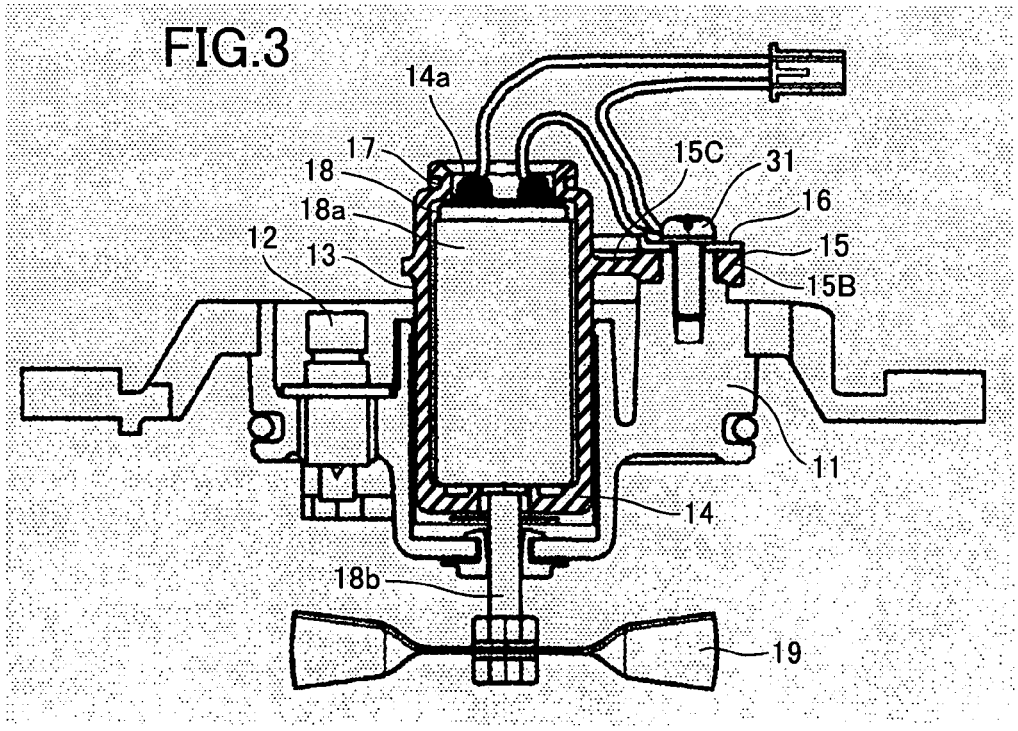
FIG. 3 is a cross-sectional view taken along the line III—III of FIG. 2 particularly showing an arrangement at a head cap of the nail gun according to the embodiment.

A head cap 11 is secured to the top of the housing 2 for closing the open top end of the housing 2. The head cap 11 supports a motor 18 at a position opposite to a combustion chamber 26 described later as shown in FIG. 3. Further, an ignition plug 12 is also supported to the head cap 11 at a position adjacent to the motor 18. The ignition plug 12 has an ignition spot exposed to the combustion chamber 26. The ignition plug 12 is ignitable upon manipulation to the trigger switch 5. An injection rod (not shown) is provided at the head cap 11.

Figure 4:
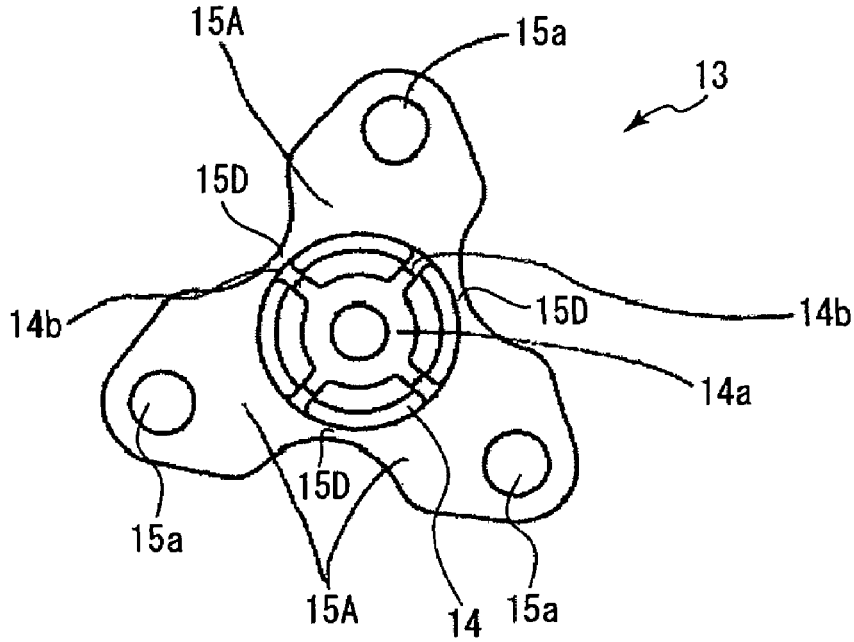
FIG. 4 is a plan view showing a damper employed in the nail gun according to the embodiment.
Figure 5:
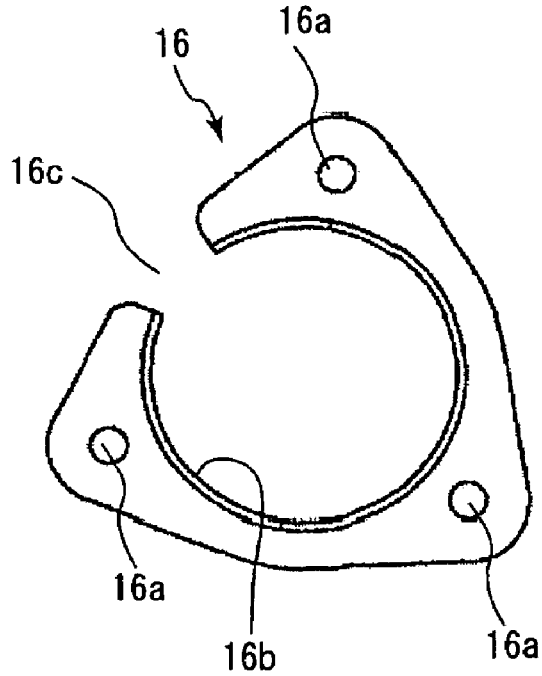
FIG. 5 is a plan view showing a support plate employed in the nail gun according to the embodiment.
Figure 6:
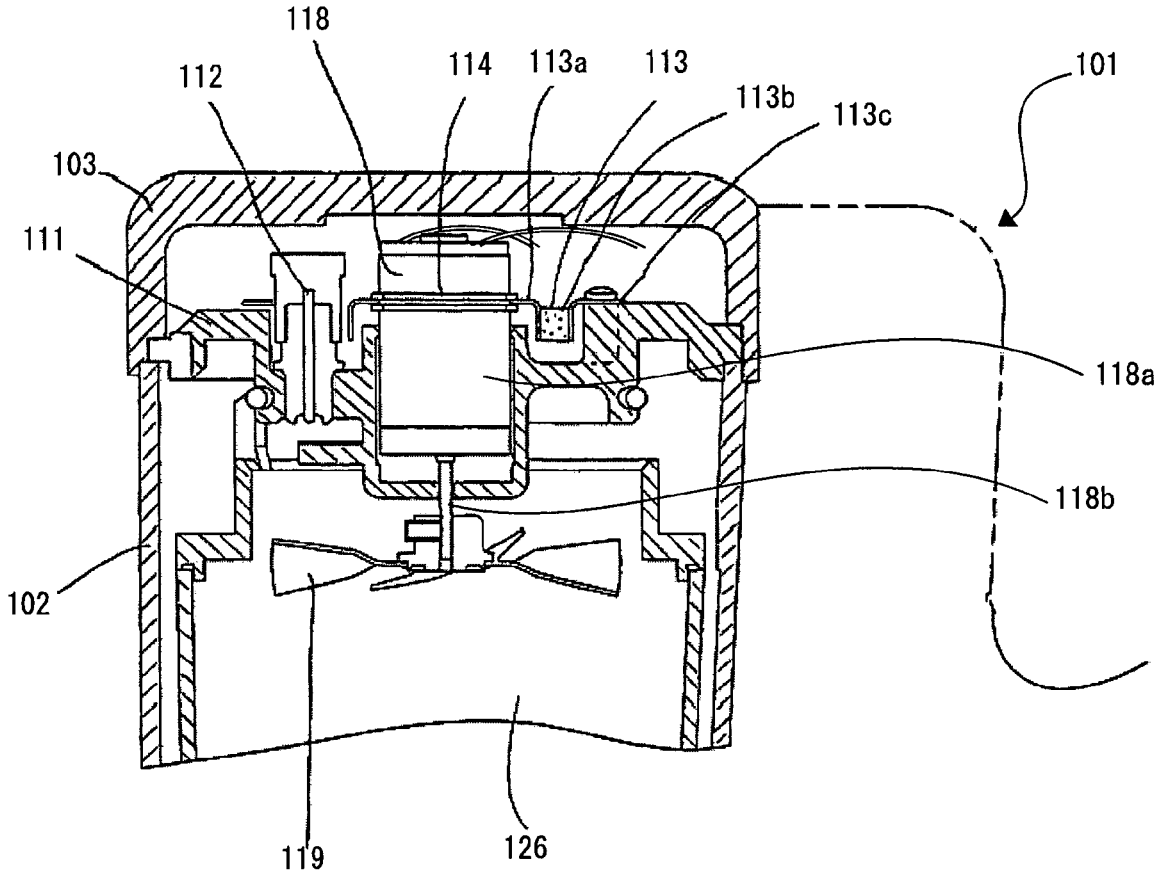
FIG.6 PRIOR ART
FIG. 6 is a cross-sectional view showing a conventional combustion type nail gun.
Figure 7:
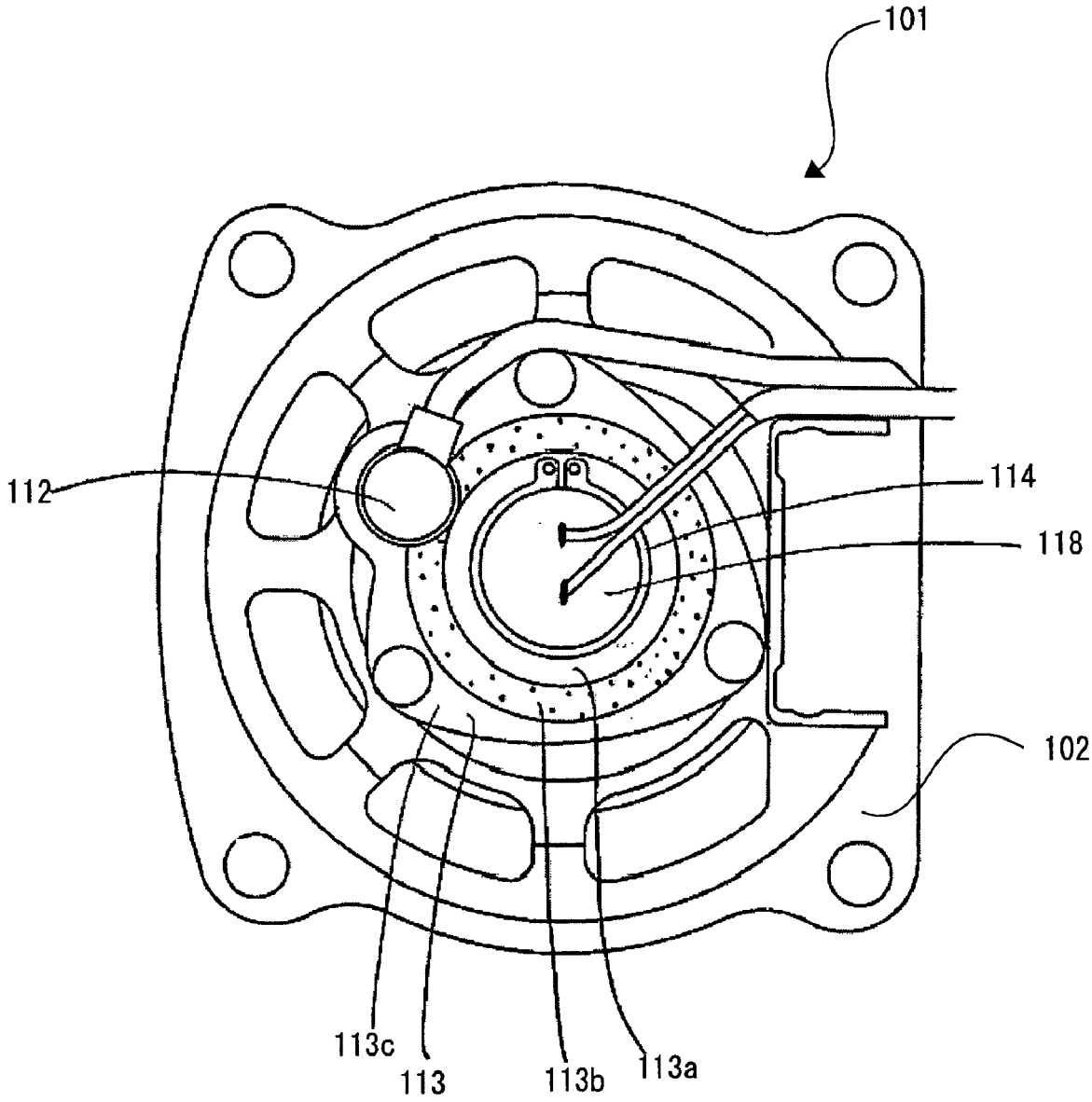
FIG.7 PRIOR ART
FIG. 7 is a cross-sectional plan view of the conventional nail gun particularly showing a motor support arrangement.

The motor 18 has a motor case 18*a* and an output shaft 18*b*, and is supported by a buffer member 13 made from an elastic material such as a rubber. The buffer member 13 includes a cylindrical motor storage section 14 and a fixing section 15. The motor storage section 14 is adapted to surround the motor case 18*a* in intimate contact therewith, and has a bottom wall formed with a through-hole through which the output shaft 18*b* extends toward the combustion chamber 26. As shown in FIG. 4, the motor storage section 14 has a motor insertion section in opposition to the bottom wall. The motor insertion section is formed with an open end 14*a* whose inner diameter is smaller than an outer diameter of the motor case 18*a*. Further, four slots 14*b* are formed in a radial direction of the motor insertion section in a cruciform fashion. Each radially inner end of the slot 14*b* is open to the open end 14*a*. Since the buffer member 13 is made from the elastic material, and since four slots 14*b* are formed at the motor insertion section, an area of the open end 14*a* can be easily enlarged for facilitating insertion and removal of the motor 18 into and from the motor storage section 14.

An annular groove is formed at an outer peripheral surface of the motor insertion section. A choke ring 17 such as a C-ring is fitted into the annular groove for maintaining the open end 14*a* at its closed fashion so as to avoid accidental removal of the motor 18 from the motor storage section 14.

As shown in FIG. 4, the fixing section 15 is provided integrally with an outer peripheral portion of the motor storage section 14. The fixing section 15 includes three buffer segments 15A protruding radially outwardly from the motor storage section 14 with an equal interval in a circumferential direction thereof. As shown in FIG. 3, each buffer segment 15A has a radially outer portion 15B serving as a fixed portion and formed with a fixing hole 15*a*, and has a radially inner portion 15C serving as a flex portion. The radially inner portion 15C has a thickness smaller than that of the radially outer portion 15B. Further, flange portions 15D protrude radially outwardly from the outer peripheral surface of the motor storage section 14. Each flange portion 15D is positioned between the neighboring buffer segments 15A. Radially protruding length of the flange portion 15D is far smaller than that of the buffer segment 15A. The motor storage section 14 has a flexibility less than that of the fixing section 15, particularly the flex portion 15C.

Figure 2:
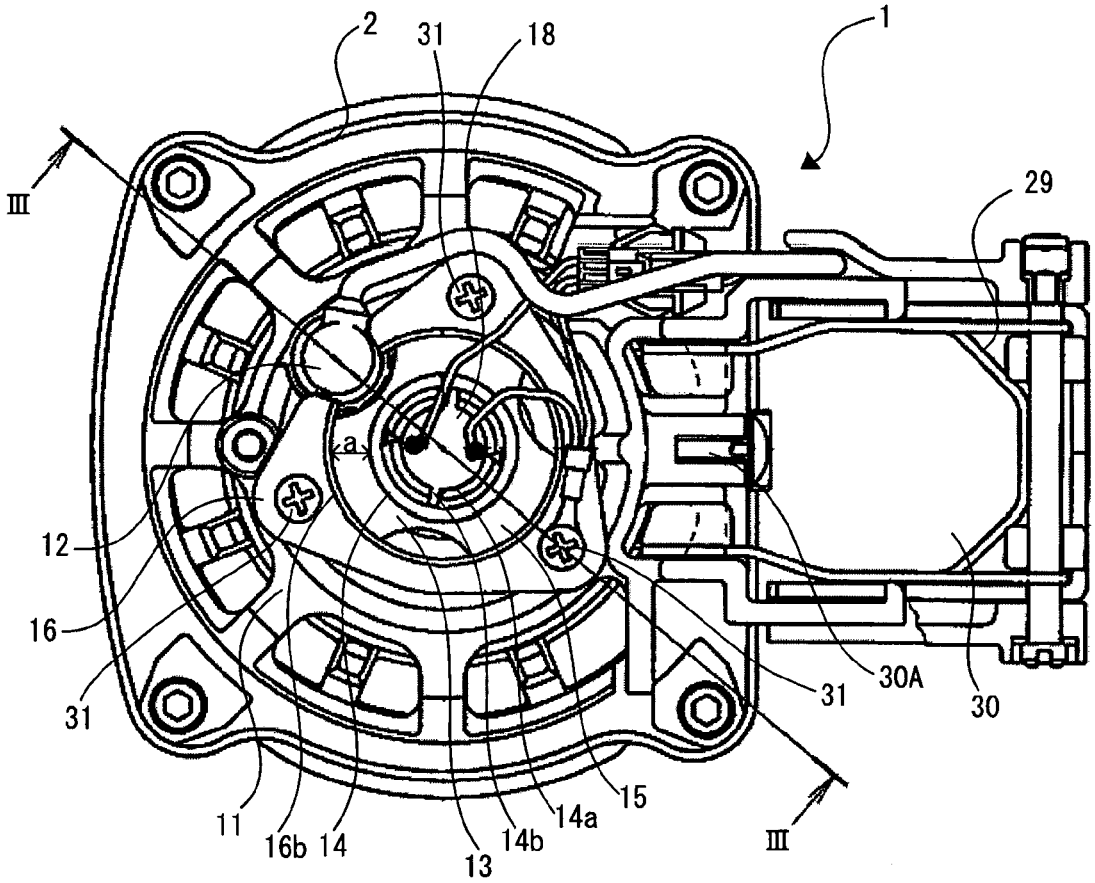
FIG. 2 is a cross-sectional plan view of the nail gun particularly showing a motor support arrangement according to the embodiment of the present invention.

A fixing plate 16 is attached to the head cap 11 by a screw 31 to fix the fixing section 15 to the fixing plate 16. The fixing plate 16 is in the form of equilateral triangle plate. Each apex portion of the fixing plate 16 is formed with a hole 16*a* in alignment with the fixing hole 15*a*. Thus, the screw 31 extends through the holes 16*a* and 15*a* and is threadingly engaged with the head cap 11. The fixing plate 16 is formed with a central hole 16*b* having an inner diameter greater than the outer diameter of the motor storage section 14 when the motor 18 is stored in the motor storage section 14, so that an annular space providing a radial distance "a" (FIG. 2) is provided between the central hole 16*b* and the motor storage section 14. Further, an opening 16*c* in communication with the central bore 16*b* is formed at one side of the fixing plate 16 for allowing the ignition plug 12 to extend through the opening 16*c*. Therefore, as shown in FIG. 2, when the plate 16 is fixed to the head cap 11, mechanical interference between the plate 16 and the motor storage section 14 and between the plate 16 and the ignition plug 12 does not occur.

For assembly, as shown in FIG. 3, each radially outer portion 15B of the buffer segment 15A of the fixing section 15 is interposed between the head cap 11 and the fixing plate 16. Then, the screws 31 are inserted through the holes 16*c* and 15*a* and are threadingly engaged with the head cap 11. Therefore, the fixing plate 16 is fixed to the head cap 11 interposing the buffer segment 15A therebetween. In this case, since the distance "a" is provided between the inner peripheral surface of the central hole 16*b* and the outer surface of the motor storage section 14, accidental nip of the flex portion 15C between the fixing plate 16 and the head cap 11 can be prevented, but the flex portion 15C is freely deformable. Further, since the flexibility of the motor storage section 14 is lower than that of the fixing section 15, particularly the flex portion 15C, and the inner peripheral surface of the motor storage section 14 is in intimate contact with the motor 18, excessive deformation of the motor storage section 14 can be prevented. Moreover, since the ignition plug 12 extends through the opening 16C, the ignition plug 12 is positioned between the neighboring buffer segments 15A and 15A. In other words, the ignition plug 12 can be positioned at radially outer side of the flange portion 15D whose protrusion amount is far smaller than that of the buffer segment 15A. Thus, mechanical interference between the ignition plug 12 and the fixing section 15 can also be prevented.

A head switch (not shown) is provided in the housing 2 for detecting an uppermost stroke end position of the combustion-chamber frame 10 when the nail gun 1 is pressed against the workpiece 28. Thus, the head switch can be turned ON when the push lever 9 is elevated to a predetermined position for starting rotation of the motor 18.

The head cap 11 has a handle side in which is formed a fuel ejection passage 25 which allows a combustible gas to pass therethrough. One end of the ejection passage 25 serves as an ejection port that opens at the lower surface of the head cap 11. Another end of the ejection passage 25 serves as a gas canister connecting portion 25A in communication with the injection rod.

The combustion-chamber frame 10 is provided in the housing 2 and is movable in the lengthwise direction of the housing 2. The uppermost end of the combustion-chamber frame 10 is abuttable on the lower peripheral side of the head cap 11. Since the arm member connects the combustion-chamber frame 10 to the push lever 9, the combustion-chamber frame 10 is movable in interlocking relation to the push lever 9. The cylinder 20 is fixed to the housing 2. The inner circumference of the combustion-chamber frame 10 is in sliding contact with an outer peripheral surface of the cylinder 20. Thus, the sliding movement of the combustion-chamber frame 10 is guided by the cylinder 20. The cylinder 20 has an axially intermediate portion formed with an exhaust hole 21. An exhaust-gas check valve (not shown) is provided to selectively close the exhaust hole 21. Further, a bumper 24 is provided on the bottom of the cylinder 20.

As shown in FIG. 1, a piston 23 is slidably and reciprocally provided in the cylinder 20. The piston 23 divides an inner space of the cylinder 20 into an upper space above the piston 23 and a lower space below the piston 23. The driver blade 23A extends downwards from a side of the piston 23, the side being at the cylinder space below the piston 23, to the nose 7. The driver blade 23A is positioned coaxially with the nail setting position in the nose 7, so that the driver blade 23A can strike against the nail during movement of the piston 23 toward its bottom dead center. The bumper 24 is made from a resilient material. When the piston 23 moves to its bottom dead center, the piston 23 abuts on the bumper 24 and stops. In this case, the bumper 24 absorbs a surplus energy of the piston 23.

When the upper end of the combustion-chamber frame 10 abuts on the head cap 11, the head cap 11, the combustion-chamber frame 10, the upper cylinder space above the piston 23 define in combustion the combustion chamber 26. When the combustion-chamber frame 10 is separated from the head cap 11, a first flow passage in communication with an atmosphere is provided between the head cap 11 and the upper end of the combustion-chamber frame 10, and a second flow passage in communication with the first flow passage is provided between the lower end portion of the combustion-chamber frame 10 and the upper end portion of the cylinder 20. These flow passages allow a combustion gas and a fresh air to pass along the outer peripheral surface of the cylinder 20 for discharging these gas through the exhaust port 2*a* of the housing 2. Further, the above-described intake port 3*a* is formed for supplying a fresh air into the combustion chamber 26, and the exhaust hole 21 is adapted for discharging combustion gas generated in the combustion chamber 26.

The fan 19 is disposed in the combustion chamber 26. Rotation of the fan 19 performs the following three functions. First, the fan 19 stirs and mixes the air with the combustible gas as long as the combustion-chamber frame 10 remains in abutment with the head cap 11. Second, after the mixed gas has been ignited, the fan 19 causes turbulent combustion of the air-fuel mixture, thus promoting the combustion of the air-fuel mixture in the combustion chamber 26. Third, the fan 19 performs scavenging such that the exhaust gas in the combustion chamber 26 can be scavenged therefrom and also performs cooling to the combustion-chamber frame 10 and the cylinder 20 when the combustion-chamber frame 10 moves away from the head cap 11 and when the first and second flow passages are provided.

A plurality of ribs (not shown) are provided on the inner peripheral portion of the combustion-chamber frame 10 which portion defines the combustion chamber 26. The ribs extend in the lengthwise direction of the combustion-chamber frame 10 and project radially inwardly toward the axis of the housing 2. The ribs cooperate with the rotating fan 19 to promote stirring and mixing of air with the combustible gas in the combustion chamber 26.

Operation of the combustion type nail gun 1 will next be described. In the non-operational state of the combustion type nail gun 1, the push lever 9 is biased downward in FIG. 1 by the biasing force of the compression coil spring 22, so that the push lever 9 protrudes from the lower end of the nose 7. Thus, the uppermost end of the combustion-chamber frame 10 is spaced away from the head cap 1 because the arm member connects the combustion-chamber frame 10 to the push lever 9. Further, a part of the combustion-chamber frame 10 which part defines the combustion chamber 26 is also spaced from the top portion of the cylinder 20. Hence, the first and second flow passages are provided. In this condition, the piston 23 stays at its top dead center in the cylinder 20.

With this state, if the push lever 9 is pushed onto the workpiece 28 while holding the handle 4 by a user, the push lever 9 is moved upward against the biasing force of the compression coil spring 22. At the same time, the combustion-chamber frame 10 which is coupled to the push lever 9, is also moved upward in FIG. 1, closing the above-described flow passages. Thus, the sealed combustion chamber 26 is provided. In accordance with the movement of the push lever 9, the gas canister is tilted toward the head cap 11 by an action of a cam (not shown). Thus, the injection rod is pressed against the connecting portion 25A of the head cap 11. Therefore, the liquidized gas in the gas canister is ejected once into the combustion chamber 26 through the ejection port of the ejection passage 25.

Further, in accordance with the movement of the push lever 9, the combustion-chamber frame 10 reaches its uppermost stroke end whereupon the head switch is turned ON to energize the motor 18 for starting rotation of the fan 19. Rotation of the fan 19 stirs and mixes the combustible gas with air in the combustion chamber 26.

In this state, when the trigger switch 5 provided at the handle 4 is turned ON, spark is generated at the ignition plug 12 to ignite the combustible gas. The combusted and expanded gas pushes the piston 23 to its bottom dead center. Therefore, a nail in the nose 7 is driven into the workpiece 28 by the driver blade 23A until the piston 23 abuts on the bumper 24.

After the nail driving, the piston 23 strikes against the bumper 24, and the combustion gas is discharged out of the cylinder 20 through the exhaust hole 21 of the cylinder 20 and through the check valve (not shown) provided at the exhaust hole 21. When the inner space of the cylinder 20 and the combustion chamber 26 becomes the atmospheric pressure, the check valve is closed.

By the combustion and expansion of the air-fuel mixture, the fan 19 is subjected to back pressure impact. Thus, acceleration is to be imparted on the motor 18 connecting to the fan 19. Further, the piston 23 consumes surplus kinetic energy as a result of impingement onto the bumper 24 in addition to the fastener driving energy. In this instance, acceleration due to the surplus energy is imparted on the entire nail gun 1, and therefore, the acceleration is to be also transmitted to the motor 18. Thus, a combined acceleration is to be imparted on the motor 18. However, since the motor 18 is supported to the head cap 11 only through the elastic fixing section 15, the energy can be absorbed at the fixing section 15, particularly at the thin flexed portion 15C. Consequently, excessive impact is not applied to the motor 18 in spite of the acceleration.

Further, since the radially outer portion 15B (fixed portion) is thicker than the radially inner portion 15C (flex portion), expansion and contraction of the fixed portion 15B can be restrained regardless of the expansion and contraction of the flex portion 15C. Thus, a positional displacement of the fixed portion 15B can be prevented. Accordingly, positional displacement of the motor 18 relative to a space defined by the head cover 3 and the housing 2 can be restrained at timings immediately before and after the shock absorption by the fixing portion 15.

Further, since the plurality of buffer segments 15A are arranged symmetrically with respect to the motor storage section 14, impact to be applied to the motor 18 can be buffered in a well-balanced manner. In other words, stress applied to each buffer segment 15A is equal to each other, to avoid local fatigue, thereby prolonging service life of the fixing member 15.

Further, since the motor storage section 14 stores the motor 18 in intimate contact therewith and has a sufficient thickness, the motor 18 is not violently moved within the motor storage section 14. Further, since expansion and contraction of the motor storage section 14 does not occur during impact, but only the buffer segments 15A are deformed because of the difference in flexibility therebetween. Further, accidental enlargement of the opening 14*a* due to the application of the shock can be prevented because of the provision of the choke ring 17. Thus, accidental removal or projection-out of the motor 18 through the opening 14*a* can be avoided.

Combustion gas still remaining in the cylinder 20 and the combustion chamber 26 has a high temperature at a phase immediately after the combustion. However, the high temperature can be absorbed into the walls of the cylinder 20 and the combustion-chamber frame 10 to rapidly cool the combustion gas.

Thus, the pressure in the sealed space in the cylinder 20 above the piston 23 further drops to less than the atmospheric pressure (creating a so-called "thermal vacuum"). Accordingly, the piston 23 is moved back to the initial top dead center position.

Then, the trigger switch 5 is turned OFF, and the user lifts the combustion type nail gun 1 from the workpiece 28 for separating the push lever 9 from the workpiece 28. As a result, the push lever 9 and the combustion-chamber frame 10 move downward due to the biasing force of the compression coil spring 22 to restore a state shown in FIG. 1. In this case, the fan 19 keeps rotating for a predetermined period of time in spite of OFF state of the trigger switch 5 because of an operation of a control portion (not shown). In the state shown in FIG. 1, the flow passages are provided again at the upper and lower sides of the combustion chamber 26, so that fresh air flows into the combustion chamber 26 through the intake port 3*a* formed at the head cover 3 and through the flow passages, expelling the residual combustion gas through the exhaust port 2*a*. Thus, the combustion chamber 26 is scavenged. Then, the rotation of the fan 19 is stopped to restore an initial stationary state. Thereafter, subsequent nail driving operation can be performed by repeating the above described operation process.

In the combustion type nail gun 1, since the buffer member 13 is an integral product and can be produced by a molding, the buffer member 13 can be produced easily. Further because of the integral product, a problem of separation and reduction in strength and durability is avoidable thereby enhancing reliability. Further, an ordinary available motor can be used without any modification.

While the invention has been described in detail and with reference to specific embodiments thereof, it would be apparent to those skilled in the art that various changes and modification may be made therein without departing from the scope of the invention. For example, the present invention is not limited to the nail gun but is available for any kind of power tools in which a combustion chamber and a piston are provided, and as long as expansion of gas as a result of combustion of air-fuel mixture in the combustion chamber causes reciprocal motion of the piston. Further, the numbers of the buffer segments 15A is not limited to three, but at least two buffer segments are required.

What is claimed is:

1. A combustion-type power tool comprising:

a housing having one end and another end and defining a longitudinal direction;

a head portion disposed at the one end and formed with a fuel passage;

a cylinder disposed in and fixed to the housing;

a nose positioned at the another end and extending from the cylinder;

a push lever movable along the nose in the longitudinal direction when pressure contacting a workpiece;

a piston reciprocally movable in the longitudinal direction and slidable relative to the cylinder, the piston dividing the cylinder into an upper space above the piston and a lower space below the piston;

a combustion-chamber frame disposed in the housing and movable in the longitudinal direction in interlocking relation to the push lever, the combustion chamber frame being abuttable on the head portion to provide a combustion chamber in cooperation with the head portion and the piston;

a motor including a motor case disposed at the head portion at a position opposite to the combustion chamber, and an output shaft extending from the motor case and protruding into the combustion chamber; and a buffer member made solely from an elastic material and comprising a motor storage section that supports and stores the motor case therein, and a fixing section integrally extending from the motor storage section and fixed to the head portion.

2. The combustion-type power tool as claimed in claim 1, wherein the motor storage section substantially surrounds and is in contact with an outer peripheral surface of the motor case which extends in the longitudinal direction.

3. The combustion-type power tool as claimed in claim 1, wherein the elastic material of the buffer member is solely rubber.

4. The combustion-type power tool comprising:

a housing having one end and another end and defining a longitudinal direction;

a head portion disposed at the one end and formed with a fuel passage;

a cylinder disposed in and fixed to the housing;

a nose positioned at the another end and extending from the cylinder;

a push lever movable along the nose in the longitudinal direction when pressure contacting a workpiece;

a piston reciprocally movable in the longitudinal direction and slidable relative to the cylinder, the piston dividing the cylinder into an upper space above the piston and a lower space below the piston;

a combustion-chamber frame disposed in the housing and movable in the longitudinal direction in interlocking relation to the push lever, the combustion chamber frame being abuttable on the head portion to provide a combustion chamber in cooperation with the head portion and the piston;

a motor including a motor case disposed at the head portion at a position opposite to the combustion chamber, and an output shaft extending from the motor case and protruding into the combustion chamber; and a buffer member made solely from an elastic material and comprising a motor storage section that supports the motor case, and a fixing section integrally extending from the motor storage section and fixed to the head portion;

wherein the motor storage section has a flexibility lower than that of the fixing section.

5. The combustion-type power tool comprising:

a housing having one end and another end and defining a longitudinal direction;

a head portion disposed at the one end and formed with a fuel passage;

a cylinder disposed in and fixed to the housing;

a nose positioned at the another end and extending from the cylinder;

a push lever movable along the nose in the longitudinal direction when pressure contacting a workpiece;

a piston reciprocally movable in the longitudinal direction and slidable relative to the cylinder, the piston dividing the cylinder into an upper space above the piston and a lower space below the piston;

a combustion-chamber frame disposed in the housing and movable in the longitudinal direction in interlocking relation to the push lever, the combustion chamber frame being abuttable on the head portion to provide a combustion chamber in cooperation with the head portion and the piston;

a motor including a motor case disposed at the head portion at a position opposite to the combustion chamber, and an output shaft extending from the motor case and protruding into the combustion chamber; and a buffer member made solely from an elastic material and comprising a motor storage section that supports the motor case, and a fixing section integrally extending from the motor storage section and fixed to the head portion;

wherein the motor storage section has a sleeve portion having one end and another end, a bottom wall portion at the one end, and a motor insertion portion at the another end and formed with an insertion opening, a motor casing being interposed between the bottom wall and the insertion portion.

6. The combustion-type power tool as claimed in claim 5, further comprising a choke member that reduces an inner diameter of the insertion opening for avoiding removal of the motor case through the insertion opening.

7. The combustion-type power tool as claimed in claim 5, wherein the motor case has an outer diameter, and the insertion opening has an inner diameter smaller than the outer diameter.

8. The combustion-type power tool as claimed in claim 5, wherein the motor casing has an outer peripheral surface in intimate contact with the sleeve portion.

9. the combustion-type power tool as claimed in claim 5, wherein the fixing section comprises at least two buffer sections having a configuration identical with each other and spaced away from each other at equal interval in a circumferential direction of the motor storage section.

10. The combustion-type power tool as claimed in claim 5, wherein each buffer section comprises a radially outer fixed portion fixed to the head portion and a radially inner flex portion projecting radially outwardly from the motor storage section, the radially outer fixed portion having a thickness greater than that of the radially inner flex portion.

11. The combustion-type power tool as claimed in claim 10, further comprising a fixing member fixed to the head portion, the radially outer fixed portion being interposed between the fixing member and the head portion.

12. The combustion-type power tool as claimed in claim 11, wherein the fixing member is formed with a central hole having an inner diameter greater than that of an outer diameter of the motor storage section storing therein the motor case.

13. The combustion-type power tool as claimed in claim 12, further comprising:

a fan fixed to the output shaft and disposed in the combustion chamber; and an ignition plug supported to the head portion and exposed to the combustion chamber, and wherein the fixing member is formed with an opening allowing the ignition plug to extend therethrough, the opening being in communication with the central hole.

14. A support structure for a motor that rotates a fan rotatable in a combustion chamber in a combustion-type power tool for driving a fastener into a workpiece, the power tool including a tool body and generating an acceleration of the motor in an axial direction of the fan upon combustion in the combustion chamber, the acceleration causing the motor to move in the axial direction relative to the tool body, the support structure comprising:

a buffer member made solely from an elastic material and comprising a motor storage section that stores the motor, and a fixing section integrally extending from the motor storage section and fixed to the tool body.

15. The support structure as claimed in claim 14, wherein the motor storage section has a flexibility lower than that of the fixing section.

16. The support structure as claimed in claim 14, wherein the motor includes a motor case and an output shaft extending from the motor case; and wherein the motor storage section has a sleeve portion having one end and another end, a bottom wall portion at the one end through which the output shaft extends, and a motor insertion portion at the another end and formed with an insertion opening, a motor casing being interposed between the bottom wall and the insertion portion.

17. The support structure as claimed in claim 16, further comprising a choke member that reduces an inner diameter of the insertion opening for avoiding removal of the motor case through the insertion opening.

18. The support structure as claimed in claim 16, wherein the motor case has an outer diameter, and the insertion opening has an inner diameter smaller than the outer diameter.

19. The support structure as claimed in claim 16, wherein the motor casing has an outer peripheral surface in intimate contact with the sleeve portion.

20. The support structure as claimed in claim 16, wherein the fixing section comprises at least two buffer sections having a configuration identical with each other and spaced away from each other at equal interval in a circumferential direction of the motor storage section.

21. The support structure as claimed in claim 16, wherein each buffer section comprises a radially outer fixed portion fixed to the tool body and a radially inner flex portion projecting radially outwardly from the motor storage section, the radially outer fixed portion having a thickness greater than that of the radially inner flex portion.

22. The support structure as claimed in claim 21, further comprising a fixing member fixed to the tool body, the radially outer fixed portion being interposed between the fixing member and the tool body.

23. The combustion-type power tool as claimed in claim 14, wherein the motor storage section substantially surrounds and is in contact with an outer peripheral surface of the motor which extends in the longitudinal direction.

24. The combustion-type power tool as claimed in claim 14, wherein the elastic material of the buffer member is solely rubber.

* * * * *